US009938924B2

(12) United States Patent
Nakano et al.

(10) Patent No.: US 9,938,924 B2
(45) Date of Patent: Apr. 10, 2018

(54) CONTROL DEVICE AND CONTROL METHOD FOR FUEL INJECTION VALVE

(71) Applicants: Tomohiro Nakano, Nagoya (JP); Eiji Murase, Nagoya (JP); Rihito Kaneko, Miyoshi (JP)

(72) Inventors: Tomohiro Nakano, Nagoya (JP); Eiji Murase, Nagoya (JP); Rihito Kaneko, Miyoshi (JP)

(73) Assignee: TOYOTA JIDOSHA KABUSHIKI KAISHA, Toyota-shi (JP)

( * ) Notice: Subject to any disclaimer, the term of this patent is extended or adjusted under 35 U.S.C. 154(b) by 154 days.

(21) Appl. No.: 14/896,548

(22) PCT Filed: May 23, 2014

(86) PCT No.: PCT/IB2014/000833

§ 371 (c)(1),
(2) Date: Dec. 7, 2015

(87) PCT Pub. No.: WO2014/195775

PCT Pub. Date: Dec. 11, 2014

(65) Prior Publication Data

US 2016/0131074 A1 May 12, 2016

(30) Foreign Application Priority Data

Jun. 7, 2013 (JP) ..... 2013-120938

(51) Int. Cl.

| | |
|---|---|
| ***F02D 41/38*** | (2006.01) |
| ***F02D 41/20*** | (2006.01) |
| ***F02M 51/06*** | (2006.01) |

(52) U.S. Cl.
CPC ..... *F02D 41/38* (2013.01); *F02D 41/20* (2013.01); *F02M 51/061* (2013.01);
(Continued)

(58) Field of Classification Search
CPC ..... F02D 41/38; F02D 41/20; F02D 41/3836; F02D 41/3845; F02D 2041/2017;
(Continued)

(56) References Cited

U.S. PATENT DOCUMENTS 5,975,053 A 11/1999 Rodier
6,571,773 B1 6/2003 Yamakado et al.
(Continued)

FOREIGN PATENT DOCUMENTS

EP 1 072 779 1/2001
EP 1 396 630 3/2004
(Continued)

OTHER PUBLICATIONS

International Search Report dated Nov. 3, 2014 in PCT/IB14/000833 Filed May 23, 2014.

*Primary Examiner* — Ian Paquette
(74) *Attorney, Agent, or Firm* — Oblon, McClelland, Maier & Neustadt, L.L.P.

(57) ABSTRACT

A control device for a fuel injection valve includes a drive circuit that controls open/close operation of the fuel injection valve by passing an exciting current through a solenoid of the fuel injection valve and an ECU that reduces a peak current value as a fuel pressure in a delivery pipe at timing of a start of energization of the fuel injection valve decreases. The ECU reduces the peak current value as an amount of fuel discharged from a high-pressure fuel pump to the delivery pipe reduces.

5 Claims, 11 Drawing Sheets

(52) U.S. Cl.
CPC ..... *F02D 41/3836* (2013.01); *F02D 41/3845* (2013.01); *F02D 2041/2017* (2013.01); *F02D 2041/2048* (2013.01); *F02D 2041/2058* (2013.01); *F02D 2200/0602* (2013.01)

(58) Field of Classification Search
CPC ..... F02D 2041/2058; F02D 2200/0602; F02D 2041/2048; F02M 51/061
See application file for complete search history.

(56) References Cited

U.S. PATENT DOCUMENTS

| | | | | |
|---|---|---|---|---|
| 2004/0040545 | A1 | 3/2004 | Nasu | |
| 2010/0263632 | A1 | 10/2010 | Miyake et al. | |
| 2010/0300412 | A1* | 12/2010 | Keegan | F02D 41/20 123/490 |
| 2016/0047330 | A1* | 2/2016 | Mukaihara | F02D 41/20 123/472 |

FOREIGN PATENT DOCUMENTS

| | | |
|---|---|---|
| JP | 2002 202027 | 7/2002 |
| JP | 2002 332929 | 11/2002 |
| JP | 2006 200510 | 8/2006 |
| JP | 2007 321582 | 12/2007 |
| JP | 2010 255444 | 11/2010 |
| JP | 2010 265822 | 11/2010 |
| JP | 2011 163312 | 8/2011 |
| JP | 2014 218983 | 11/2014 |

* cited by examiner

CONTROL DEVICE AND CONTROL METHOD FOR FUEL INJECTION VALVE

BACKGROUND OF THE INVENTION

1. Field of the Invention

The invention relates to a control device and control method for a fuel injection valve, which cause the fuel injection valve provided in an internal combustion engine to open or close.

2. Description of Related Art

An energization time of a fuel injection valve in single fuel injection is divided into an opening period for opening the fuel injection valve and a holding period for holding the valve-open state of the fuel injection valve. During the opening period, electromagnetic force that is generated at the fuel injection valve gradually increases with an increase in exciting current flowing through a solenoid of the fuel injection valve, and the fuel injection valve is opened. When the exciting current reaches a peak current value that is determined as a current value for reliably opening the fuel injection valve, the opening period ends, and the holding period starts. During the holding period, the exciting current steeply decreases from the peak current value and is held near a holding current value, and the electromagnetic force generated at the fuel injection valve is held by a force required to hold the valve-open state (for example, see Japanese Patent Application Publication No. 2007-321582 (JP 2007-321582 A)).

JP 2007-321582 A describes that the peak current value is made variable on the basis of an energization time of the fuel injection valve and an open operation period that is a period during which the fuel injection valve is actually open.

SUMMARY OF THE INVENTION

The fuel injection valve is configured to inject fuel supplied from the inside of a delivery pipe, and becomes more hard to open as the fuel pressure in the delivery pipe increases. In other words, the fuel injection valve tends to open earlier as the fuel pressure in the delivery pipe decreases. Therefore, when the peak current value is made variable, it is conceivable to reduce the peak current value as the fuel pressure in the delivery pipe at the start of energization of the fuel injection valve decreases. The fact that the peak current value is small means that the maximum value of the electromagnetic force that can be generated at the fuel injection valve in single fuel injection reduces. Therefore, when the peak current value is reduced, residual magnetic force after the end of energization of the fuel injection valve tends to reduce, so it is possible to suppress a delay in the closing of the fuel injection valve after the end of energization.

Incidentally, the fuel pressure in the delivery pipe during engine operation decreases as a result of fuel injection from the fuel injection valve, whereas the fuel pressure increases through supply of fuel from a high-pressure fuel pump, so the fuel pressure pulsates. Thus, if the peak current value is excessively reduced, when the fuel pressure in the delivery pipe increases due to pulsation and then the fuel injection valve becomes hard to open, the opening of the fuel injection valve may delay.

Such a delay in the opening of the fuel injection valve leads to an insufficient injection amount of fuel, so it is desirable to avoid such a delay as much as possible. Therefore, for example, it is also conceivable that a method of determining the peak current value at a slightly larger value such that a delay in the opening of the fuel injection valve does not occur even when the fuel pressure in the delivery pipe is fully increased due to pulsation.

However, with such a method, a delay in the opening of the fuel injection valve is allowed to be avoided, but the peak current value is not allowed to be reduced so much, so it is not possible to sufficiently suppress a delay in the closing of the fuel injection valve after the end of energization.

The invention provides a control device and control method for a fuel injection valve, which are able to suppress a delay in the closing of the fuel injection valve after the end of energization while avoiding a delay in the opening of the fuel injection valve by appropriately determining a peak current value.

A first aspect of the invention provides a control device for a fuel injection valve. The control device includes: an electronic control unit configured to: (a) control open/close operation of the fuel injection valve by passing exciting current to a solenoid of the fuel injection valve that injects fuel supplied from a delivery pipe, (b) reduce a peak current value of the exciting current, with which the solenoid is energized, as a fuel pressure in the delivery pipe decreases at timing of a start of energization of the fuel injection valve, and (c) reduce the peak current value as an amount of fuel discharged from a high-pressure fuel pump to the delivery pipe reduces.

It may be estimated that pulsation of the fuel pressure in the delivery pipe reduces as the amount of fuel discharged from the high-pressure fuel pump reduces. In this way, as pulsation of the fuel pressure in the delivery pipe reduces, the amount of increase in the fuel pressure due to the pulsation reduces, so a delay in the opening of the fuel injection valve due to an increase in the fuel pressure is hard to occur.

In the above configuration, the peak current value is determined on the basis of not only the fuel pressure in the delivery pipe at the timing of the start of energization but also the amount of fuel discharged from the high-pressure fuel pump. Thus, even when the fuel pressure in the delivery pipe at the timing of the start of energization is about the same, the peak current value is increased as pulsation of the fuel pressure, which can be generated in the delivery pipe, increases. Therefore, when a large amount of fuel is supplied from the high-pressure fuel pump to the delivery pipe and then the fuel pressure increases) it is possible to suppress a delay in the opening of the fuel injection valve by increasing the peak current value.

When the amount of fuel discharged from the high-pressure fuel pump is small, the peak current value is reduced. That is, even when the fuel pressure in the delivery pipe at the timing of the start of energization is about the same, the peak current value is reduced as pulsation of the fuel pressure, which can be generated in the delivery pipe, reduces. By controlling the fuel injection valve on the basis of the thus determined peak current value, it is possible to reduce the electromagnetic force that is generated at the fuel injection valve. In this case, residual magnetic force after the end of energization tends to reduce, so it is possible to suppress a delay in the closing of the fuel injection valve after the end of energization.

Thus, by appropriately determining the peak current value on the basis of the amount of fuel discharged from the high-pressure fuel pump, which correlates with the amount of increase in the fuel pressure, it is possible to reduce the electromagnetic force that is generated at the fuel injection valve as much as possible while avoiding a delay in the opening of the fuel injection valve, so it is possible to suppress a delay in the closing of the fuel injection valve.

There is a fuel supply system for an internal combustion engine, in which the amount of fuel discharged from the high-pressure fuel pump is controlled such that a sensor value of the fuel pressure in the delivery pipe, which is detected by a fuel pressure sensor, is held higher than or equal to a fuel pressure prescribed value. In this case, the amount of fuel discharged from the high-pressure fuel pump reduces as the difference between the sensor value of the fuel pressure and the fuel pressure prescribed value reduces, that is, as the sensor value of the fuel pressure becomes closer to the fuel pressure prescribed value.

In the control device for a fuel injection valve, which causes the fuel injection valve to inject fuel stored in the delivery pipe of the thus configured fuel supply system, the peak current value may be reduced as the difference between the sensor value of the fuel pressure and the fuel pressure prescribed value (predetermined value) reduces. With this configuration, by monitoring the sensor value of the fuel pressure and determining the peak current value on the basis of the difference between the sensor value and the fuel pressure prescribed value (predetermined value), it is possible to implement a configuration that the peak current value is reduced as the amount of fuel that is discharged from the high-pressure fuel pump reduces. By controlling fuel injection from the fuel injection valve on the basis of the peak current value, it is possible to suppress a delay in the closing of the fuel injection valve after the end of energization while avoiding a delay in the opening of the fuel injection valve.

Incidentally, in the fuel injection valve that is controlled by the above-described control device for a fuel injection valve, in the case where the determined energization time is short, the degree of magnetization of the solenoid varies with the magnitude of the peak current value even when the energization time is equal, so it becomes difficult to appropriately control the fuel injection amount through control over the energization time. Therefore, when such a short energization time that the degree of magnetization of the solenoid of the fuel injection valve varies with the magnitude of the peak current value is determined in this way, it is desirable not to vary the peak current value but to fix the peak current value to a constant value in order to appropriately control the fuel injection amount. On the other hand, when such a long energization time that the degree of magnetization of the solenoid is hard to vary with the size of the peak current value is determined, it is desirable to make the peak current value variable in order to suppress a delay in the opening of the fuel injection valve and a delay in the closing of the fuel injection valve.

It is assumed that a lower limit value is set for the peak current value and a time during which the exciting current is passed through the solenoid of the fuel injection valve is termed energization time. In addition, a reference energization time (predetermined time) is set in advance on the basis of a time that bounds whether the degree of magnetization of the solenoid of the fuel injection valve varies with the magnitude of the peak current value. In the above-described control device for a fuel injection valve, when the energization time of the fuel injection valve is shorter than the reference energization time (predetermined time), the peak current value may be set to a value equal to the lower limit value. In this case, when the energization time is shorter than the reference energization time (predetermined time), the peak current value is fixed to a value equal to the lower limit value irrespective of the fuel pressure in the delivery pipe at the timing of the start of energization or the amount of fuel discharged from the high-pressure fuel pump. Thus, even when the energization time is short, it is possible to appropriately control the fuel injection amount from the fuel injection valve.

On the other hand, when the energization time is longer than or equal to the reference energization time, a variation in the degree of magnetization of the solenoid of the fuel injection valve due to a difference in the peak current value is hard to influence the fuel injection amount. Therefore, when the energization time is longer than or equal to the reference energization time, the peak current value is determined on the basis of the fuel pressure in the delivery pipe and the amount of fuel discharged from the high-pressure fuel pump, and the fuel injection valve is controlled on the basis of the peak current value. Thus, it is possible to suppress a delay in the closing of the fuel injection valve after the end of energization while avoiding a delay in the opening of the fuel injection valve.

When the exciting current flowing through the solenoid of the fuel injection valve increases, the electromagnetic force that is generated at the fuel injection valve increases with an increase in the exciting current. At this time, as the rate of increase in the exciting current increases, the electromagnetic force increases with a delay from an increase in the exciting current. Therefore, when the rate of increase in the exciting current is high, the electromagnetic force that is actually generated at the timing at which the exciting current has reached the peak current value becomes smaller than a theoretical value of the electromagnetic force based on the magnitude of the peak current value. Thus, when the peak current value is equal, as the rate of increase in the exciting current increases, the maximum value of the electromagnetic force that is generated at the fuel injection valve in single fuel injection tends to be small, and an opening failure of the fuel injection valve tends to occur.

Therefore, in the control device for a fuel injection valve, the peak current value may be increased as the rate of increase in the exciting current flowing through the solenoid of the fuel injection valve from the start of energization of the fuel injection valve increases. With this configuration, the electromagnetic force that is actually generated at the fuel injection valve at the timing at which the exciting current has reached the peak current value, that is, the maximum value of the electromagnetic force that is generated at the fuel injection valve in single fuel injection, is allowed to be increased. Thus, it is possible to further reliably increase the electromagnetic force that is actually generated at the fuel injection valve to the electromagnetic force that is able to open the fuel injection valve, so it is possible to suppress occurrence of an opening failure of the fuel injection valve.

When timing at which the exciting current flowing through the solenoid exceeds a predetermined current value (first current value) in process in which the exciting current increases is termed prescribed rising detection timing, the fact that a time from the timing of the start of energization to the prescribed rising detection timing, regarding as first time, is short means that the rate of increase in the exciting current from the start or energization is high. Therefore, by employing the configuration that the peak current value is increased as a time from the timing of the start of energization of the fuel injection valve to the prescribed rising detection timing becomes shorter, it is possible to implement a configuration that increases the peak current value as the rate of increase in the exciting current flowing through the solenoid from the start of energization of the fuel injection valve increases.

A resistance of the solenoid that constitutes the fuel injection valve can vary due to individual difference in terms of manufacturing, aged degradation, and the like. The current value flowing through the solenoid of the fuel injection valve may deviate from a command value from the control device due to the above-described variations in the resistance of the solenoid. For example, when the peak value of the actual exciting current is smaller than the peak current value that is determined as the command value, the maximum value of the electromagnetic force that can be generated at the fuel injection valve in single fuel injection reduces, so an opening failure of the fuel injection valve may occur. On the other hand, when the peak value of the actual exciting current is larger than the peak current value that is determined as the command value, the maximum value of the electromagnetic force that can be generated at the fuel injection valve in single fuel injection increases, so a delay in the closing of the fuel injection valve after the end of energization easily occurs.

Therefore, when timing at which the exciting current flowing through the solenoid exceeds a reference current value (second current value) smaller than the peak current value in process in which the exciting current increases is termed reference rising detection timing and timing at which the exciting current flowing through the solenoid becomes smaller than the reference current value (second current value) in process in which the exciting current decreases from the peak current value is termed reference falling detection timing, in the control device for a fuel injection valve, the peak current value may be reduced when a second time from the reference rising detection timing to the reference falling detection timing exceeds a reference value determined on the basis of the magnitude of the peak current value. On the other hand, the peak current value may be increased when the time from the reference rising detection timing to the reference falling detection timing is shorter than the reference value.

In the above configuration, for example, the reference value is set in advance as a value that corresponds to the time from the reference rising detection timing to the reference falling detection timing in the case where the command value of the peak current value coincides with the peak value of the actual exciting current. When the time from the reference rising detection timing to the reference falling detection timing exceeds the reference value, it may be estimated that a peak value of an actual exciting current is larger than a command value of the peak current value, so the peak current value is reduced in this case. Thus, it is possible to reduce the maximum value of the electromagnetic force that can be generated at the fuel injection valve in single fuel injection, and residual magnetic force after the end of energization is allowed to be easily reduced, so it is possible to suppress a delay in the closing of the fuel injection valve after the end of energization.

On the other hand, when the time from the reference rising detection timing to the reference falling detection timing is shorter than the reference value, it may be estimated that the peak value of the actual exciting current is smaller than the command value of the peak current value, so the peak current value is increased in this case. Thus, it is possible to increase the maximum value of the electromagnetic force that can be generated at the fuel injection valve in single fuel injection, so it is possible to suppress occurrence of an opening failure of the fuel injection valve.

Thus, with the above configuration, it is possible to appropriately determine the peak current value in consideration of variations in the resistance of the solenoid due to individual difference in terms of manufacturing, aged degradation, and the like.

A second aspect of the invention provides a control method for a fuel injection valve. The control method includes: controlling open/close operation of the fuel injection valve by passing exciting current through a solenoid of the fuel injection valve that injects fuel supplied from an inside of a delivery pipe, with the use of an electronic control unit; reducing a peak current value of current, with which the solenoid is energized, as a fuel pressure in the delivery pipe at timing of a start of energization of the fuel injection valve decreases, with the use of the electronic control unit; and reducing the peak current value as an amount of fuel discharged from a high-pressure fuel pump to the delivery pipe reduces, with the use of the electronic control unit.

BRIEF DESCRIPTION OF THE DRAWINGS

Features, advantages, and technical and industrial significance of exemplary embodiments of the invention will be described below with reference to the accompanying drawings, in which like numerals denote like elements, and wherein:

FIG. 3A, FIG. 3B and FIG. 3C are examples of timing charts in the case where fuel is injected from one of the fuel injection valves, in which FIG. 3A shows changes in the level of an energization signal that is output from an ECU to a drive circuit, FIG. 3B shows changes in exciting current that flows through a solenoid of the one of the fuel injection valves, and FIG. 3C shows changes in an valve-open/closed state of the one of the fuel injection valves;

DETAILED DESCRIPTION OF EMBODIMENTS

Figure 1:
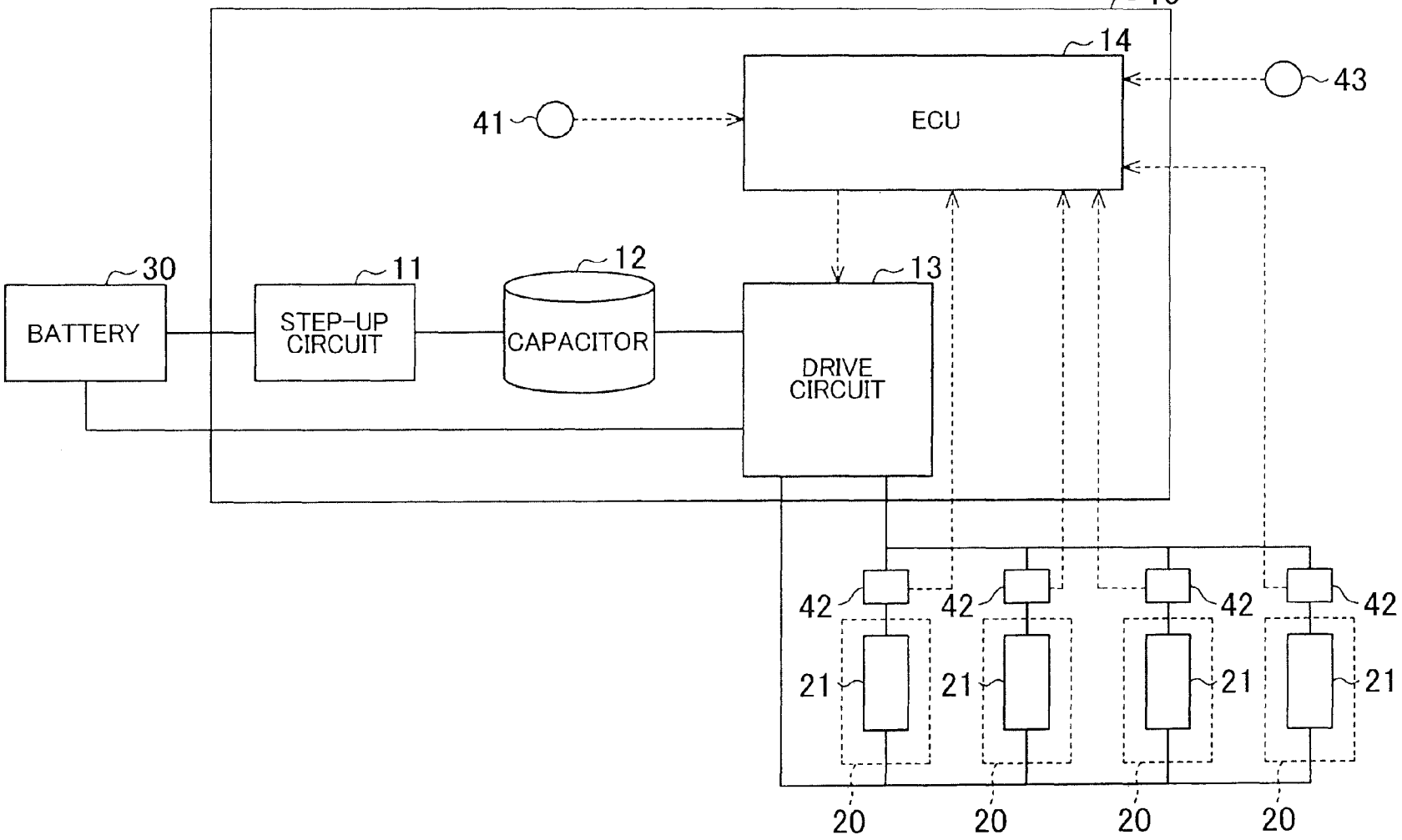
FIG. 1 is a schematic view that shows the schematic configuration of a control device for fuel injection valves according to an embodiment and the plurality of fuel injection valves that are controlled by the control device.

Hereinafter, one example embodiment of a control device for a fuel injection valve, which causes the fuel injection valve provided in an internal combustion engine to open or close, will be described with reference to FIG. 1 to FIG. 14. FIG. 1 shows a control device 10 for fuel injection valves according to the present embodiment and the plurality of (four in this embodiment) that are controlled by the control device 10. Each of these fuel injection valves 20 is a direct-injection injection valve that directly injects fuel into a corresponding one of combustion chambers of the internal combustion engine.

As shown in FIG. 1, the control device 10 includes a step-up circuit 11, a capacitor 12 and a drive circuit 13. The step-up circuit 11 steps up the voltage of a battery 30. The battery 30 is provided in a vehicle. The capacitor 12 is charged with the voltage stepped up by the step-up circuit 11. The drive circuit 13 serves as a drive control unit. The drive circuit 13 is configured to drive the fuel injection valves 20 by selectively using one of the capacitor 12 and the battery 30 as a power supply depending on an occasion under control of an electronic control unit (hereinafter, referred to as "ECU") 14 also having the function as a peak determination unit.

The ECU 14 includes a microcomputer that is formed of a CPU, a ROM, a RAM, and the like. Various control programs that are executed by the CPU, and the like, are prestored in the ROM. Information that is updated as needed is stored in the RAM.

Various detection systems, such as a voltage sensor 41, current detection circuits 42 and a fuel pressure sensor 43, are electrically connected to the ECU 14. The voltage sensor 41 is configured to detect a capacitor voltage Vc that is the voltage of the capacitor 12. Each of the current detection circuits 42 is configured to detect an exciting current Iinj flowing through a solenoid 21 of a corresponding one of the fuel injection valves 20. The current detection circuits 42 are provided in correspondence with the fuel injection valves 20. The fuel pressure sensor 43 is configured to detect a fuel pressure in a delivery pipe provide in a fuel supply system connected to the fuel injection valves 20. The control device 10 including the ECU 14 is configured to control each fuel injection valve 20 on the basis of information that is detected by the various detection systems.

Figure 2:
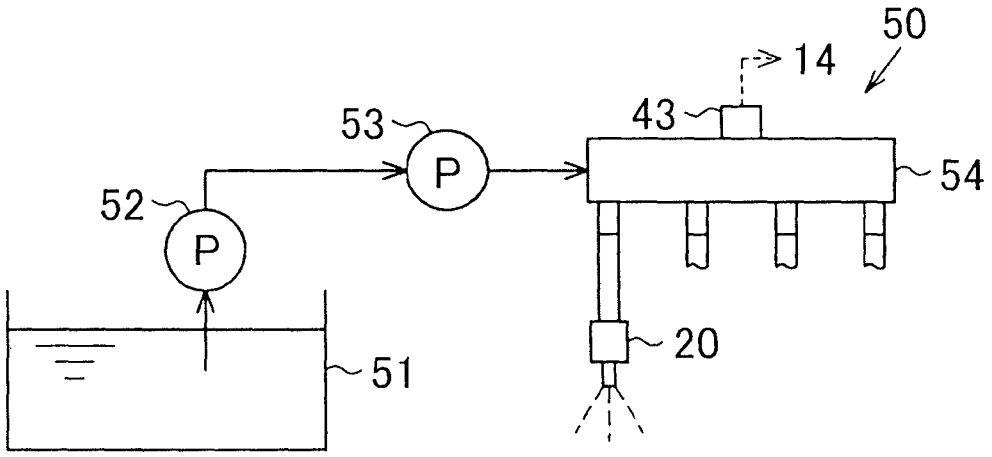
FIG. 2 is a schematic view that shows the schematic configuration of a fuel supply system that supplies fuel to the fuel injection valves.

Next, the fuel supply system 50 that supplies fuel to the fuel injection valves 20 will be described with reference to FIG. 2. As shown in FIG. 2, the fuel supply system 50 includes a low-pressure fuel pump 52, a high-pressure fuel pump 53 and the delivery pipe 54. The low-pressure fuel pump 52 draws fuel from a fuel tank 51 in which fuel is stored. The high-pressure fuel pump 53 pressurizes and discharges fuel discharged from the low-pressure fuel pump 52. High-pressure fuel discharged from the high-pressure fuel pump 53 is stored in the delivery pipe 54. Fuel in the delivery pipe 54 is supplied to the fuel injection valves 20.

Figures 3A, 3B, 3C:
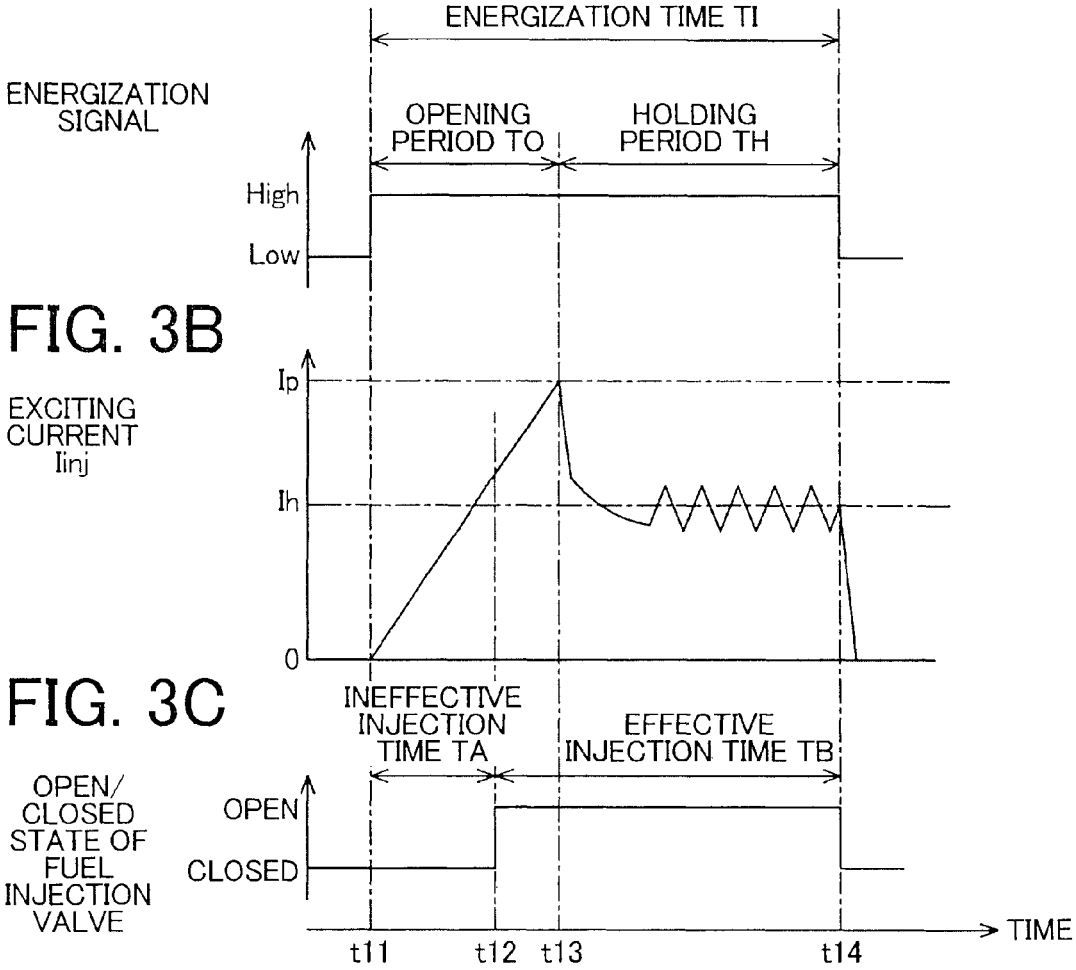

Next, a mode in which current is supplied to each of the fuel injection valves 20 will be described with reference to FIG. 3A, FIG. 3B and FIG. 3C. As shown in FIG. 3A, FIG. 3B and FIG. 3C, when the level of an energization signal that is output from the ECU 14 to the drive circuit 13 changes from "Low" to "High", an exciting current Iinj starts flowing through the solenoid 21 of the corresponding fuel injection valve 20. That is, a period from first timing t11 at which the level of the energization signal changes from "Low" to "High" to fourth timing t14 at which the level of the energization signal changes from "High" to "Low" is an energization time TI during which the fuel injection valve 20 is energized.

At the first timing t11 that is the timing at which energization of the fuel injection valve 20 is started, the fuel injection valve 20 is closed. Here, in order to open the fuel injection valve 20, current is supplied to the fuel injection valve 20 with the use of the capacitor 12 as a power supply. The capacitor 12 is able to apply a voltage higher than that of the battery 30. In this case, because the exciting current Iinj flowing through the solenoid 21 gradually increases, an electromagnetic force that is generated at the solenoid 21 also gradually increases. At second timing t12 in the middle of an increase in the exciting current Iinj, the fuel injection valve 20 opens, and fuel is injected from the fuel injection valve 20.

A time from the first timing t11 to the second timing t12 is regarded as an ineffective injection time TA during which fuel is not injected yet from the fuel injection valve 20 although energization of the fuel injection valve 20 is started. A time from the second timing t12 to the fourth timing t14 at which energization of the fuel injection valve 20 ends is regarded as an effective injection time TB during which fuel is actually injected from the fuel injection valve 20.

When the exciting current Iinj flowing through the solenoid 21 reaches a peak current value Ip at third timing t13 after the second timing t12, an opening period TO for opening the fuel injection valve 20 ends, and a holding period TH for holding the valve-open state of the fuel injection valve 20 starts. The peak current value Ip is a command value determined as a current value for reliably opening the fuel injection valve 20. As a result, the power supply is changed by the drive circuit 13 from the capacitor 12 to the battery 30, and the voltage that is applied to the solenoid 21 of the fuel injection valve 20 decreases, so the exciting current Iinj steeply decreases. The rate of decrease in the exciting current Iinj at this time is remarkably higher than the rate of increase at the time when the exciting current Iinj increases toward the peak current value Ip. That is, when the exciting current Iinj decreases from the peak current value Ip, a variation in the exciting current Iinj is steep.

The exciting current Iinj that decreases from the peak current value Ip is adjusted near a predetermined holding current value Ih such that an electromagnetic force that is able to hold the valve-open state of the fuel injection valve 20 is generated from the solenoid 21. After that, when the energization signal changes from "High" to "Low" at the fourth timing t14, energization of the fuel injection valve 20 is ended, and the fuel injection valve 20 closes.

The energization time TI is determined on the basis of a required injection amount that is set for single fuel injection, so the energization time TI is reduced as the required injection amount reduces. That is, when the required injection amount is small, energization of the fuel injection valve 20 may be ended in the opening period TO in which the fuel injection valve 20 is energized from the capacitor 12.

Here, the electromagnetic force that is generated at the fuel injection valve 20 increases as the exciting current Iinj flowing through the solenoid 21 increases. Therefore, as the peak current value Ip that is determined as the command value increases, the maximum value of the electromagnetic force that is allowed to be generated at the fuel injection valve 20 in single fuel injection tends to increase. At the time of such fuel injection in which a large electromagnetic force is generated, an opening failure of the fuel injection valve 20 is hard to occur.

On the other hand, when the exciting current Iinj flowing through the solenoid 21 immediately before the end of energization is large, a residual magnetic force immediately after the end of energization increases, so a delay in the closing of the fuel injection valve 20 after the end of energization tends to occur. In order to suppress such a delay in the closing of the fuel injection valve 20, it is desirable to reduce the peak current value Ip as much as possible such that an excessively large electromagnetic force is not generated at the fuel injection valve 20. Therefore, the control device 10 for the fuel injection valves according to the present embodiment suppresses a delay in the closing of each fuel injection valve 20 immediately after the end of energization by reducing the peak current value Ip as much as possible within the range in which an opening failure of the fuel injection valve 20 does not occur.

Next, a processing routine that is executed by the ECU 14 of the control device 10 for the fuel injection valves according to the present embodiment will be described with reference to the flowchart shown in FIG. 4. The processing routine is a processing routine that is executed at the timing at which energization of each fuel injection valve 20 is started.

Figure 4:
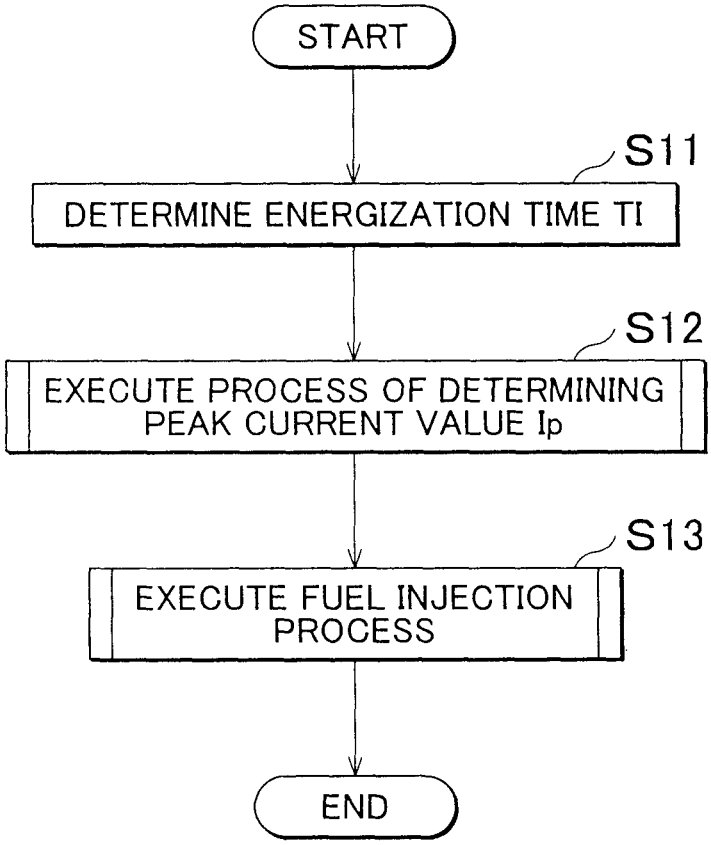
FIG. 4 is a flowchart that illustrates a processing routine that is executed in the control device for the fuel injection valves according to the embodiment at the time when fuel is injected from each fuel injection valve.

As shown in FIG. 4, in the processing routine, the ECU 14 determines the energization time TI on the basis of the required injection amount (step S11). Subsequently, the ECU 14 executes determination process for determining the peak current value Ip for current fuel injection (step S12). The determination process for determining the peak current value will be described later with reference to FIG. 5. The ECU 14 executes fuel injection process for controlling the fuel injection valve 20 on the basis of the energization time TI determined in step S11 and the peak current value Ip determined in step S12 (step S13). After that, the ECU 14 ends the processing routine.

Figure 7A:
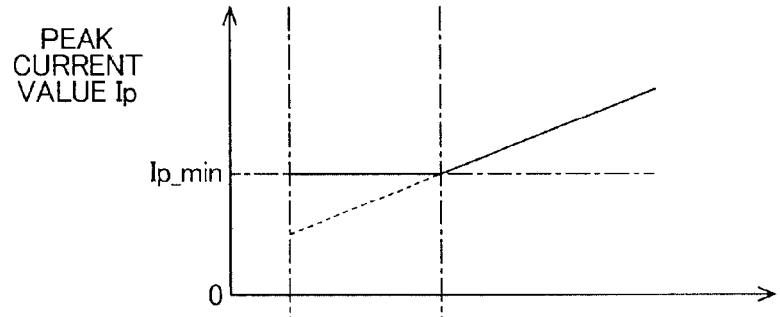
FIG. 7A is a map that shows the correlation between an energization time and a peak current value.

Next, the routine of the determination process for determining the peak current value Ip in step S12 will be described with reference to the flowchart shown in FIG. 5, the timing charts shown in FIG. 7A, FIG. 7B and FIG. 11 and the maps shown in FIG. 8 to FIG. 10 and FIG. 12.

Figure 5:
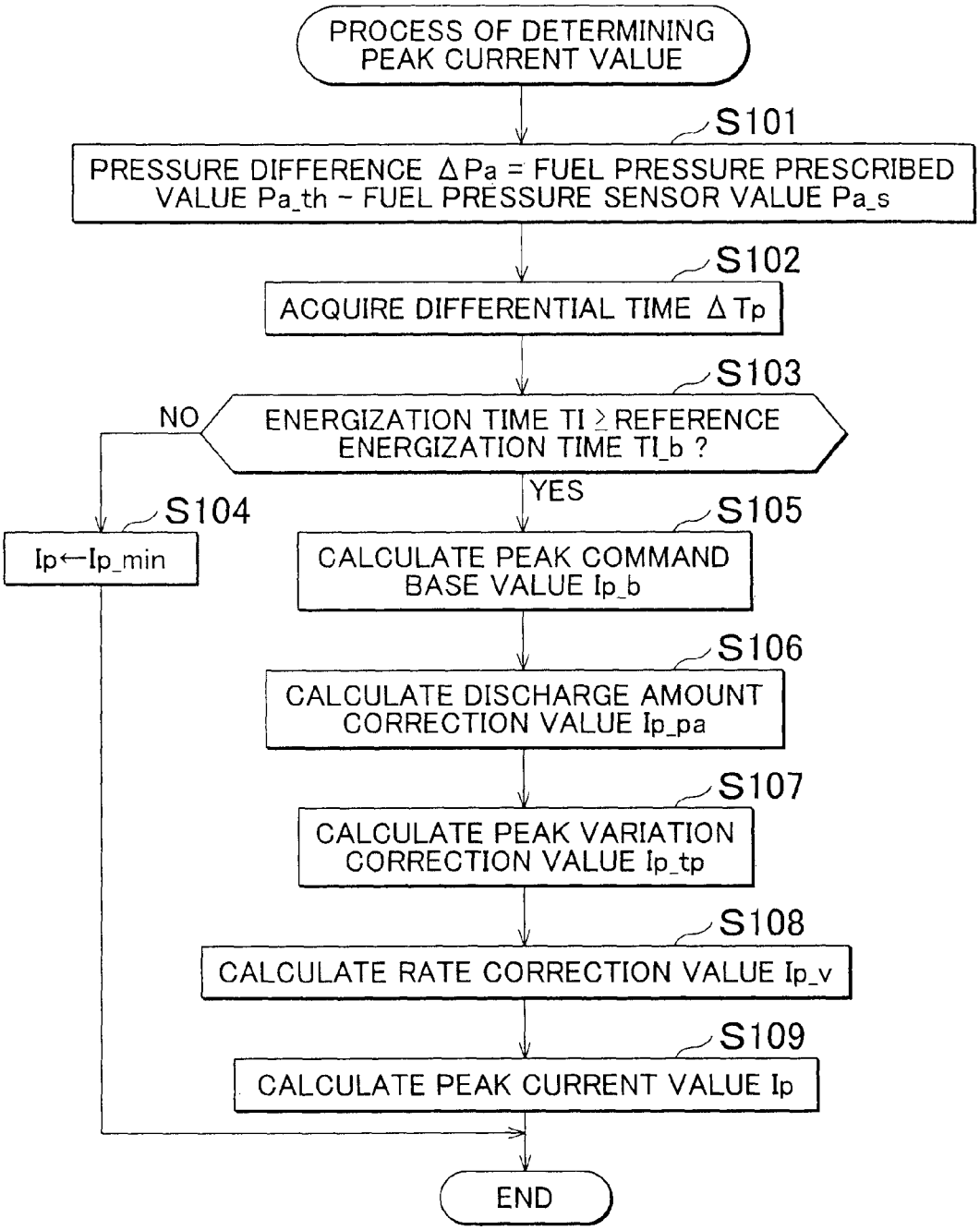
FIG. 5 is a flowchart that illustrates a processing routine that is executed in the control device in order to determine a peak current value.

As shown in FIG. 5, in the processing routine, the ECU 14 subtracts a fuel pressure sensor value Pa_s from a fuel pressure prescribed value Pa_th and sets the difference (=Pa_th−Pa_s) for a pressure difference ΔPa (step S101). The fuel pressure prescribed value Pa_th is a target value of the fuel pressure in the delivery pipe 54. The fuel pressure sensor value Pa_s is a sensor value of the fuel pressure, detected by the fuel pressure sensor 43.

When fuel injection from the fuel injection valve 20 is started, the fuel pressure in the delivery pipe 54 decreases. As a result, the fuel pressure sensor value Pa_s that is detected by the fuel pressure sensor 43 also decreases. The amount of fuel discharged from the high-pressure fuel pump 53 is controlled such that the fuel pressure in the delivery pipe 54 becomes higher than or equal to the fuel pressure prescribed value Pa_th. That is, the amount of fuel discharged from the high-pressure fuel pump 53 increases as the pressure difference ΔPa increases. In short, even when the fuel pressure sensor value Pa_s is the same, but when the fuel pressure prescribed value Pa_th that is the target value of the fuel pressure at that time is high, the pressure difference ΔPa increases, and the amount of discharge increases. As the pressure difference ΔPa increases, the amount of fuel discharged from the high-pressure fuel pump 53 thereafter increases. Therefore, the fuel pressure in the delivery pipe 54 pulsates by a large amount due to driving of the high-pressure fuel pump 53. Thus, the magnitude of pulsation of the fuel pressure in the delivery pipe 54 is allowed to be estimated on the basis of the pressure difference ΔPa.

Subsequently, the ECU 14 loads the differential time ΔTp, already calculated before current fuel injection and stored in a memory, from the memory (step S102). The differential time ΔTp is an index value that indicates a deviation between the peak current value Ip, which is the command value, and the peak value of the actual exciting current Iinj at the time of energization, and is calculated through a calculation process that will be described later with reference to FIG. 6. The ECU 14 determines whether the energization time TI determined for current fuel injection is longer than or equal to a reference energization time TI_b (step S103).

Figure 7B:
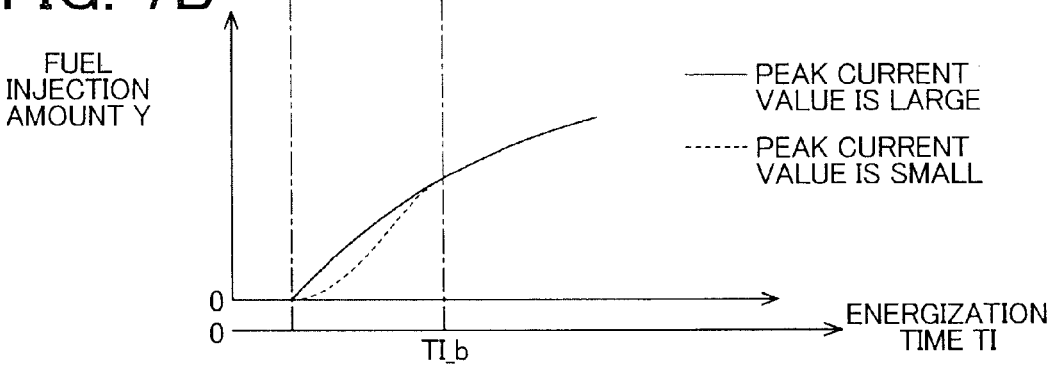
FIG. 7B is a map that shows the correlation between an energization time and an injection amount of fuel from each fuel injection valve.

As shown in FIG. 7B, when the energization time TI is long, the injection amount Y of fuel has almost no difference between when the peak current value Ip is large and when the peak current value Ip is small and is determined on the basis of the length of the energization time TI. The injection amount Y increases as the energization time TI extends. On the other hand, when the energization time TI is short, there occurs a difference between the injection amount Y in the case where the peak current value Ip is small and the injection amount Y in the case where the peak current value Ip is large even when the energization time TI is the same, as indicated by the dashed line in FIG. 7B.

The reason why the correlation between the energization time TI and the injection amount Y changes with a difference in the magnitude of the peak current value Ip when the energization time TI is short in this way is that energization ends during the opening period TO in the case where the energization time TI is extremely short. The rate of increase in the exciting current Iinj in the opening period TO can change on the basis of the magnitude of the peak current value Ip. Specifically, as the peak current value Ip increases, the rate of increase in the exciting current Iinj increases. Therefore, when energization is ended during the opening period TO, that is, when energization is ended before the exciting current Iinj reaches the peak current value Ip, the magnitude of the exciting current Iinj at the timing of the end of energization varies on the basis of the magnitude of the peak current value Ip. That is, even when the energization time TI is the same, the rate of increase in the exciting current Iinj increases as the peak current value Ip increases, so the exciting current Iinj at the time of the end of energization increases.

As the exciting current Iinj at the timing of the end of energization increases, a residual magnetic force immediately after the end, of energization increases. As a result, immediately after the end of energization, the lift amount of the fuel injection valve 20 is hard to reduce, so the closing of the fuel injection valve 20 delays. When the closing of the fuel injection valve 20 delays in this way, the amount of fuel that is injected from the fuel injection valve 20 after the end of energization increases as compared to the case where the peak current value Ip is small even when the energization time TI is the same. In addition, due to the difference in the magnitude of the peak current value Ip in the opening period TO, there also can occur a difference in a time up to when the fuel injection valve 20 opens, that is, the ineffective injection time TA. Specifically, as the peak current value Ip increases, the rate of increase in the exciting current Iinj increases, so the valve opening becomes early, and the ineffective injection time TA becomes short. When the energization time TI is short, the original injection amount Y in itself is small, so the influence of such a difference in the ineffective injection time TA on the injection amount Y also increases.

In contrast, when the energization time TI is long, the exciting current Iinj reaches the peak current value Ip, and energization is ended after the opening period TO ends and shifts into the holding period TH. Because the exciting current Iinj is adjusted to near the holding current value Ih during the holding period TH, when energization is ended after shifting into the holding period TH, the magnitude of the exciting current Iinj at the timing of the end of energization becomes the magnitude near the holding current value Ih irrespective of the magnitude of the peak current value Ip. Thus, when the energization time TI is long and energization is ended after shifting into the holding period TH, a difference is hard to occur in the magnitude of residual magnetic force immediately after the end of energization, so a difference is hard to occur in the injection amount Y even when the magnitude of the peak current value Ip is different. When the energization time TI is long, the original injection amount Y in itself is large, so the influence of such a difference in the ineffective injection time TA on the injection amount Y is small.

Thus, when the energization time TI is long, the correlation between the energization time TI and the injection amount Y is hard to change even when there is a difference in the magnitude of the peak current value Ip; whereas, when the energization time TI is short, the correlation between the energization time TI and the injection amount Y changes due to a difference in the magnitude of the peak current value Ip. Therefore, in the case where the energization time TI is short, if the peak current value Ip is changed on the basis of the energization time TI as indicated by the dashed line in FIG. 7A, the correlation between the energization time TI and the injection amount Y changes accordingly, so control over the injection amount Y becomes extremely difficult.

The control device 10 for the fuel injection valves according to the present embodiment determines the reference energization time TI_b on the basis of the energization time that bounds whether the injection amount Y of fuel that can be injected from the fuel injection valve 20 in single fuel injection varies with a variation in the peak current value Ip. When the energization time TI is shorter than the reference energization time TI_b, the energization time TI is short, and the correlation between the energization time TI and the injection amount Y changes with the magnitude of the peak current value Ip, so a lower limit value Ip_min is set for the peak current value Ip. That is, when the energization time TI is longer than or equal to the reference energization time TI_b as indicated by the continuous line in FIG. 7A, determination of the peak current value Ip based on the fuel pressure sensor value Pa_s at the time of the start of energization and the amount of fuel discharged from the high-pressure fuel pump 53 is allowed, whereas the peak current value Ip is fixed to the lower limit value Ip_min when the energization time TI is shorter than the reference energization time TI_b.

Referring back to FIG. 5, when the energization time TI is shorter than the reference energization time TI_b (NO in step S103), the ECU 14 determines the peak current value Ip to a value equal to the lower limit value Ip_min (see FIG. 7A) of the peak current value (step S104), and the processing routine is ended. On the other hand, when the energization time TI is longer than or equal to the reference energization time TI_b (YES in step S103), the ECU 14 determines the peak current value Ip on the basis of the fuel pressure sensor value Pa_s detected by the fuel pressure sensor 43 and the amount of fuel discharged from the high-pressure fuel pump 53 (step S105 to step S109).

Initially, the ECU 14 calculates a peak command base value Ip_b on the basis of the fuel pressure sensor value Pa_s detected by the fuel pressure sensor 43 (step S105), and calculates a discharge amount correction value Ip_pa on the basis of the pressure difference ΔPa calculated in step S101 (step S106).

As the fuel pressure in the delivery pipe 54 at the timing of the start of energization increases, an opening failure, such as a delay in the opening of the fuel injection valve 20, more easily occurs. Therefore, in order to suppress occurrence of an opening failure, such as a delay in the opening of the fuel injection valve 20, it is desirable to increase the peak current value Ip as the fuel pressure at the timing of the start of energization increases.

Fuel is also supplied from the high-pressure fuel pump 53 to the delivery pipe 54 in the middle of energization of the fuel injection valve 20. As a result, the fuel pressure in the delivery pipe 54 pulsates in the middle of energization of the fuel injection valve 20. Therefore, in order to suppress an opening failure of the fuel injection valve 20, it is required to consider an increase in fuel pressure due to pulsation, and the peak current value Ip is desirably set to a larger value as the amount of fuel discharged from the high-pressure fuel pump 53 to the delivery pipe 54 increases.

Figure 8:
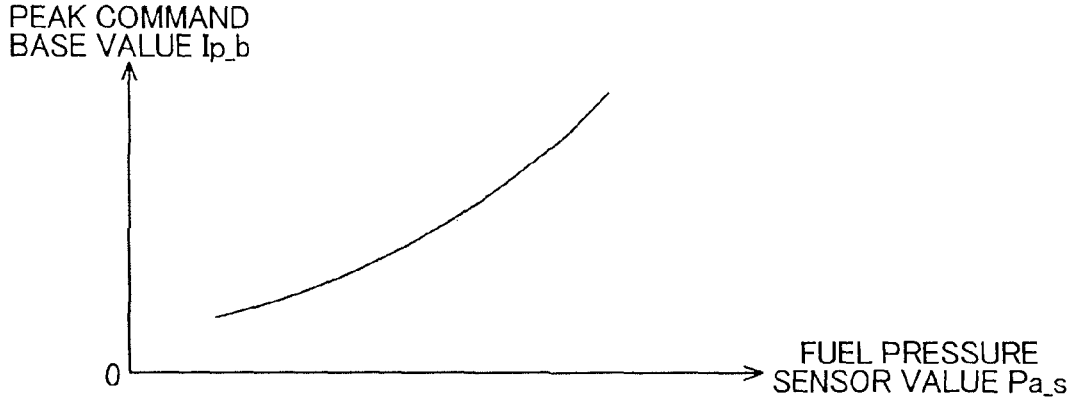
FIG. 8 is a map that shows the correlation between a fuel pressure sensor value and a peak command base value.
Figure 9:
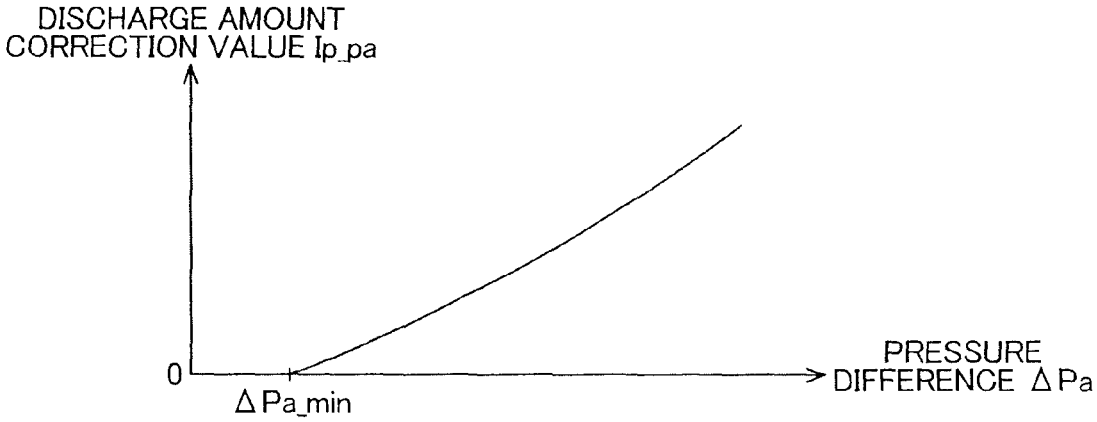
FIG. 9 is a map that shows the correlation between a pressure difference and a discharge amount correction value.

Therefore, the control device 10 for the fuel injection valves according to the present embodiment calculates the peak command base value Ip_b by using the map shown in FIG. 8 such that the peak command base value Ip_b increases as the fuel pressure sensor value Pa_s increases, and calculates the discharge amount correction value Ip_pa by using the map shown in FIG. 9 such that the discharge amount correction value Ip_pa increases as the pressure difference ΔPa increases.

The map shown in FIG. 8 shows the correlation between the fuel pressure sensor value Pa_s and the peak command base value Ip_b. As shown in FIG. 8, the peak command base value Ip_b increases as the fuel pressure sensor value Pa_s increases.

The map shown in FIG. 9 shows the correlation between the pressure difference ΔPa and the discharge amount correction value Ip_pa. When the pressure difference ΔPa is smaller than or equal to a lower limit pressure difference ΔPa_min, the amount of discharge is extremely small even when fuel is discharged from the high-pressure fuel pump 53 to the delivery pipe 54 in the middle of fuel injection, and pulsation of the fuel pressure in the delivery pipe 54 is small, so it is allowed to estimate that the response of the opening of the fuel injection valve 20 almost does not change. Therefore, as shown in FIG. 9, when the pressure difference ΔPa is smaller than or equal to the lower limit pressure difference ΔPa_min, the discharge amount correction value Ip_pa becomes "0 (zero)". On the other hand, when the pressure difference ΔPa is larger than the lower limit pressure difference ΔPa_min, the amount of discharge is large when fuel is discharged from the high-pressure fuel pump 53 toward the delivery pipe 54 in the middle of fuel injection, and pulsation of the fuel pressure in the delivery pipe 54 increases, so it is allowed to estimate that the response of the opening of the fuel injection valve 20 changes. Therefore, when the pressure difference ΔPa is larger than the lower limit pressure difference ΔPa_min, the discharge amount correction value Ip_pa increases as the pressure difference ΔPa increases.

Referring back to FIG. 5, the ECU 14, which has calculated the discharge amount correction value Ip_pa in step S106, calculates a peak variation correction value Ip_tp on the basis of the differential time ΔTp acquired in step S102 (step S107).

A deviation between the peak current value Ip, which is the command value, and the peak value of the actual exciting current Iinj may lead to an opening failure of the fuel injection valve 20. In order to suppress such an opening failure, it is desirable to estimate the amount of deviation between the command value of the peak current value and the peak value of the actual exciting current Iinj in advance and then to calculate the peak current value. Ip in consideration of the estimated result. Therefore, the control device 10 for the fuel injection valves according to the present embodiment calculates the differential time ΔTp as a value corresponding to the deviation. By using the map shown in FIG. 10, the peak variation correction value Ip_tp is determined such that the peak variation correction value Ip_tp reduces as the difference (=ΔTp−ΔTp_b) obtained by subtracting the reference differential time ΔTp_b from the differential time ΔTp increases.

Figure 10:
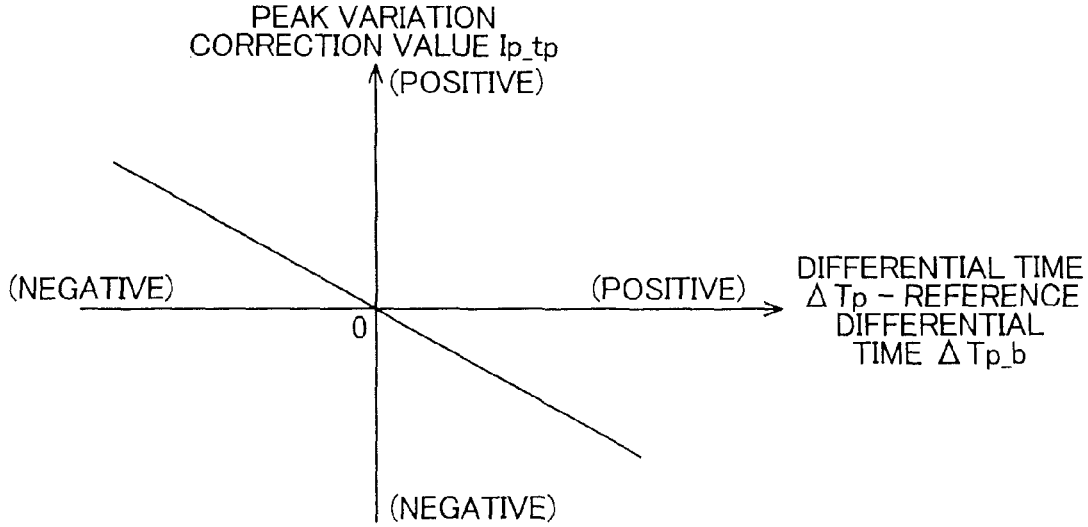
FIG. 10 is a map that shows the correlation between a difference obtained by subtracting a reference differential time from a differential time and a peak variation correction value.

The map shown in FIG. 10 shows the correlation between the difference (=. ΔTp−ΔTp_b), obtained by subtracting the reference differential time ΔTp_b from the differential time ΔTp, and the peak variation correction value Ip_tp. As shown in FIG. 10, when the difference is "0 (zero)", it may be estimated that there is almost no deviation between the command value of the peak current value and the peak value of the actual exciting current Iinj, so the peak variation correction value Ip_tp becomes "0 (zero)". When the difference is a positive value, it may be estimated that the peak value of the actual exciting current Iinj is larger than the peak current value Ip that is the command value, so the peak variation correction value Ip_tp is set to a negative value such that the peak current value Ip is reduced. In addition, when the difference is a positive value in this way, the peak variation correction value Ip_tp reduces as the difference increases. On the other hand, when the difference is a negative value, it may be estimated that the peak value of the actual exciting current Iinj is smaller than the peak current value Ip that is the command value, so the peak variation correction value Ip_tp is set to a positive value such that the peak current value Ip is increased. In addition, when the difference is a negative value in this way, the peak variation correction value Ip_tp increases as the difference reduces.

Referring back to FIG. 5, the ECU 14, which has calculated the peak variation correction value Ip_tp in step S107, calculates a rate correction value Ip_v on the basis of the rate of increase in the exciting current Iinj flowing through the solenoid 21 (step S108).

When the exciting current Iinj flowing through the solenoid 21 increases toward the peak current value Ip, the electromagnetic force that is generated at the fuel, injection valve 20 increases with an increase in the exciting current Iinj. At this time, as th rate of increase in the exciting current Iinj increases, the electromagnetic force increases with a delay from an increase in the exciting current Iinj. Therefore, when the rate of increase in the exciting current Iinj is high, a difference between the actually generated electromagnetic force and a theoretical value of electromagnetic force based on the magnitude of the peak current value Ip tends to increase at the timing at which the exciting current Iinj has reached the peak current value Ip. Thus, when the peak current value Ip is equal, the maximum value of the electromagnetic force that is generated at the fuel injection valve 20 tends to reduce as the rate of increase in the exciting current Iinj increases, and an opening failure of the fuel injection valve 20 tends to occur. Therefore, in order to suppress occurrence of an opening failure, it is desirable to increase the peak current value Ip as the rate of increase in the exciting current Iinj increases.

Figure 11:
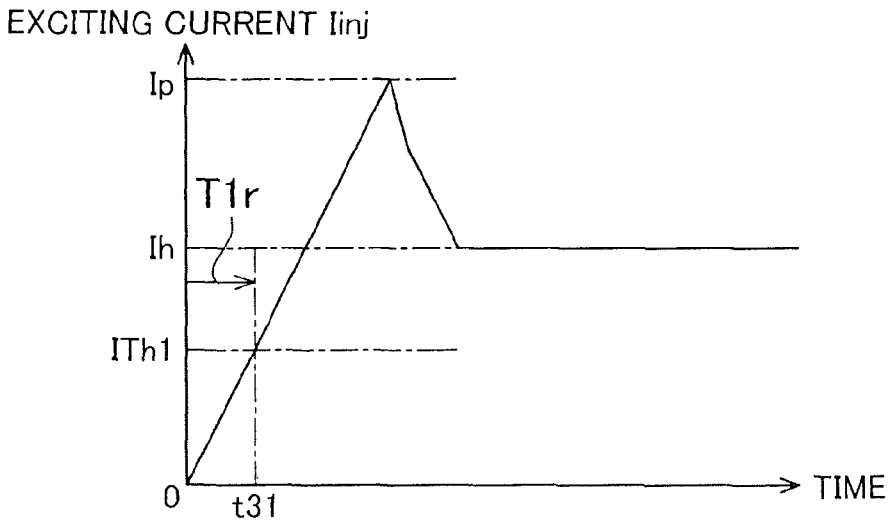
FIG. 11 is a timing chart that shows a variation in exciting current.

Therefore, as shown in FIG. 11, the control device 10 for the fuel injection valves according to the present embodiment measures a prescribed rising time T1*r* as an index value that indicates the magnitude of the rate of increase in the exciting current Iinj. The prescribed rising time T1*r*, regarding as first time, is a time from the timing of the start of energization to timing t31 at which the exciting current Iinj reaches a prescribed current value ITh1. The prescribed current value ITh1 is, for example set to a value smaller than the holding current value Ih in advance, and the prescribed rising time T1*r* tends to be shorter as the rate of increase in the exciting current Iinj increases. Therefore, the control device 10 is allowed to estimate, by using the map shown in FIG. 12, that the rate of increase in the exciting current Iinj is higher as the prescribed rising time T1*r* becomes shorter, so the control device 10 increases the rate correction value Ip_v.

Figure 12:
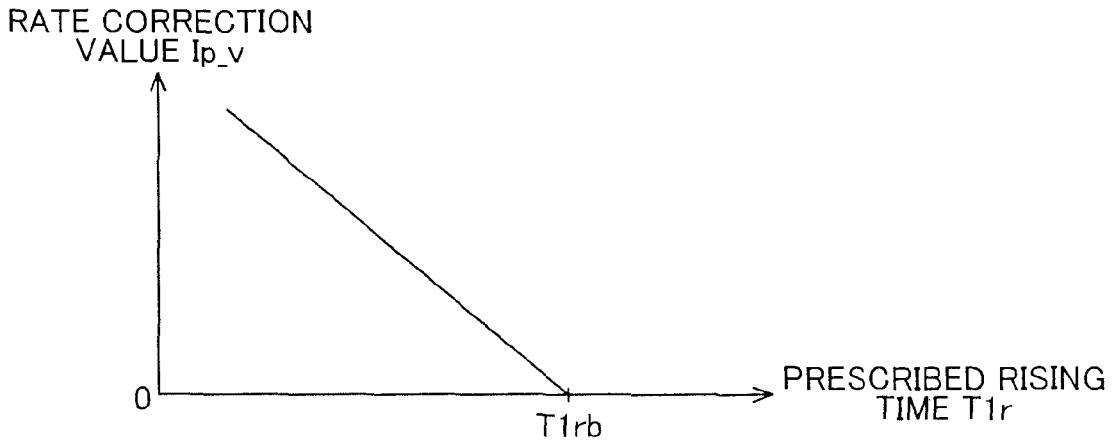
FIG. 12 is a map that shows the correlation between a prescribed rising time and a rate correction Value.

The map shown in FIG. 12 shows the correlation between the prescribed rising time T1*r* and the rate correction value Ip_v. When the prescribed rising time T1*r* is longer than a first prescribed rising time T1*rb*, the rate of increase in the exciting current Iinj is significantly low, so it may be estimated that there occurs almost no difference between the electromagnetic force that is actually generated at the timing at which the exciting current Iinj has reached the peak current value Ip and the theoretical value of the electromagnetic force based on the magnitude of the peak current value Ip. Therefore, as shown in FIG. 12, when the prescribed rising time T1*r* is longer than the first prescribed rising time T1*rb*, it may be determined that the length of the energization time does not need to be corrected in terms of the rate of increase in the exciting current Iinj, so the rate correction value Ip_v is set to "0 (zero)". On the other hand, when the prescribed rising time T1*r* is shorter than or equal to the first prescribed rising time T1*rb*, it may be determined that the length of the energization time should be corrected in terms of the rate of increase in the exciting current Iinj, so the rate correction value Ip_v is increased as the prescribed rising time T1*r* reduces.

Referring back to FIG. 5, the ECU 14, which has calculated the rate correction value Ip_v in step S108, calculates the peak current value Ip that is the command value by substituting the values Ip_b, Ip_pa, Ip_tp, Ip_v, respectively determined in step S105 to step S108, into the following relational expression (1) (step S109). After that, the ECU 14 ends the processing routine.

$$Ip=Ip_b+Ip_pa+Ip_tp+Ip_v \quad (1)$$

Next, the routine of a calculation process for calculating the differential time ΔTp will be described with reference to the flowchart shown in FIG. 6 and the timing charts shown in FIG. 13 and FIG. 14. The processing routine is a processing routine that is executed at the timing at which energization of each fuel injection valve 20 ends.

Figure 6:
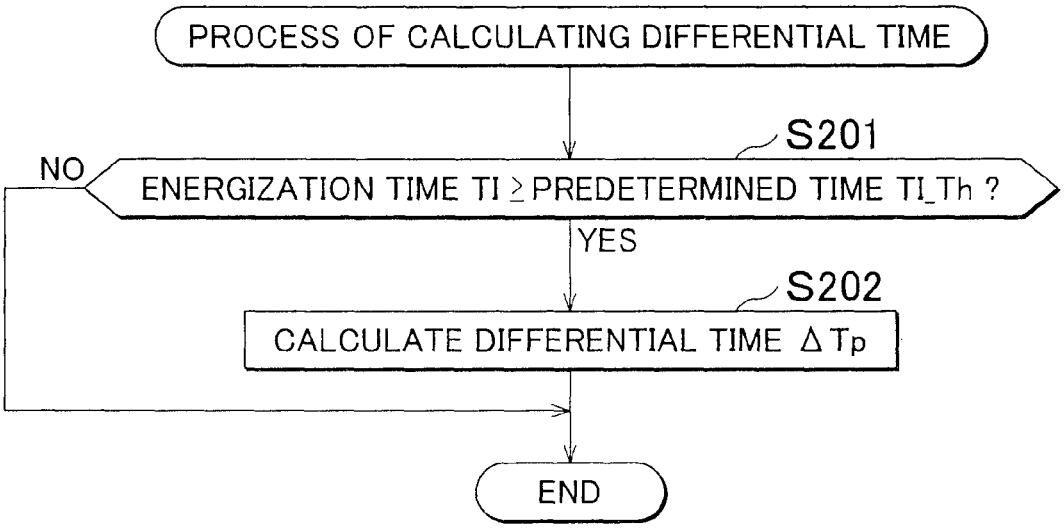
FIG. 6 is a flowchart that illustrates a processing routine that is executed in the control device in order to calculate a differential time.

As shown in FIG. 6, in the processing routine, the ECU 14 determines whether the energization time TI determined for currently ended fuel injection is longer than or equal to a preset predetermined time TI_Th (step S201). The predetermined time TI_Th is a value for determining that energization of currently ended fuel injection has reliably continued for the holding period TH. Thus, when the predetermined time TI_Th is set to a time having a length to such a degree that, when the energization time TI exceeds the predetermined time TI_Th, it may be determined that energization has continued for the holding period TH irrespective of the magnitude of the peak current value Ip.

When the energization time TI is shorter than the predetermined time TI_Th, energization of the fuel injection valve 20 may be ended before the exciting current Iinj reaches the peak current value Ip, that is, in the middle of the opening period TO. Therefore, when the energization time TI is shorter than the predetermined time TI_Th (NO in step S201), the ECU 14 ends the processing routine without calculating the differential time ΔTp. On the other hand, when the energization time TI is longer than or equal to the predetermined time TI_Th (YES in step S201), the ECU 14 calculates the differential time ΔTp (step S202), and the processing routine is ended.

Here, a method of calculating the differential time ΔTp will be described with reference to FIG. 13 and FIG. 14. The continuous lines shown in FIG. 13 and FIG. 14 each show changes in the exciting current Iinj in the case where the peak value of the actual exciting current Iinj is equal to the peak current value Ip that is the command value. The dashed line in FIG. 13 shows changes in the exciting current Iinj in the case where the peak value of the actual exciting current Iinj is smaller than the peak current value Ip that is the command value. The dashed line in FIG. 14 shows changes in the exciting current Iinj in the case where the peak value of the actual exciting current Iinj is larger than the peak current value Ip.

Figure 13:
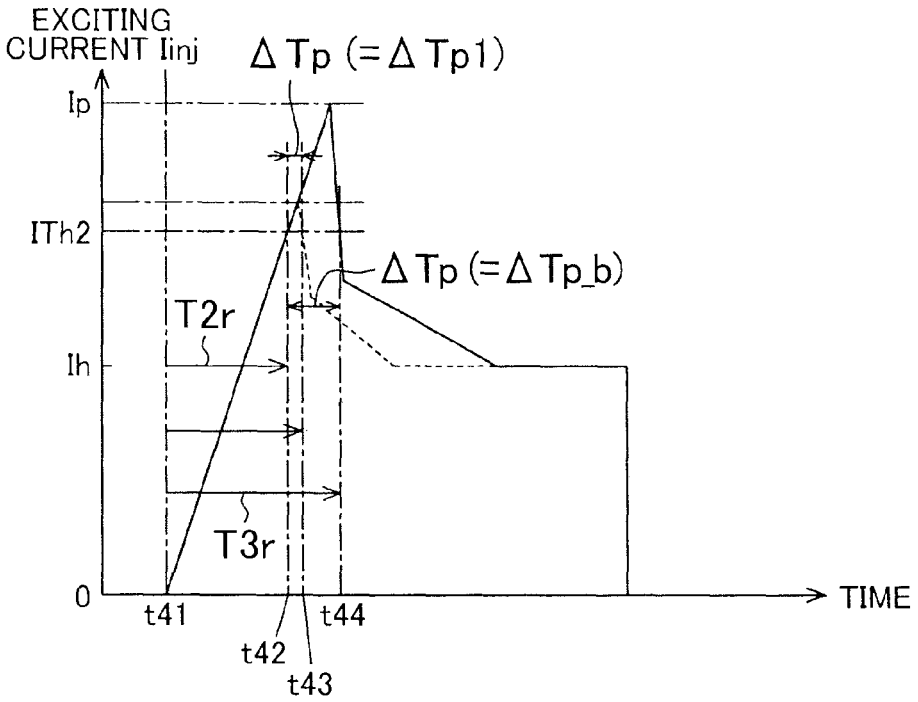
FIG. 13 is a timing chart that shows changes in exciting current in the case where a peak value of an actual exciting current is smaller than a command value of a peak current value.
Figure 14:
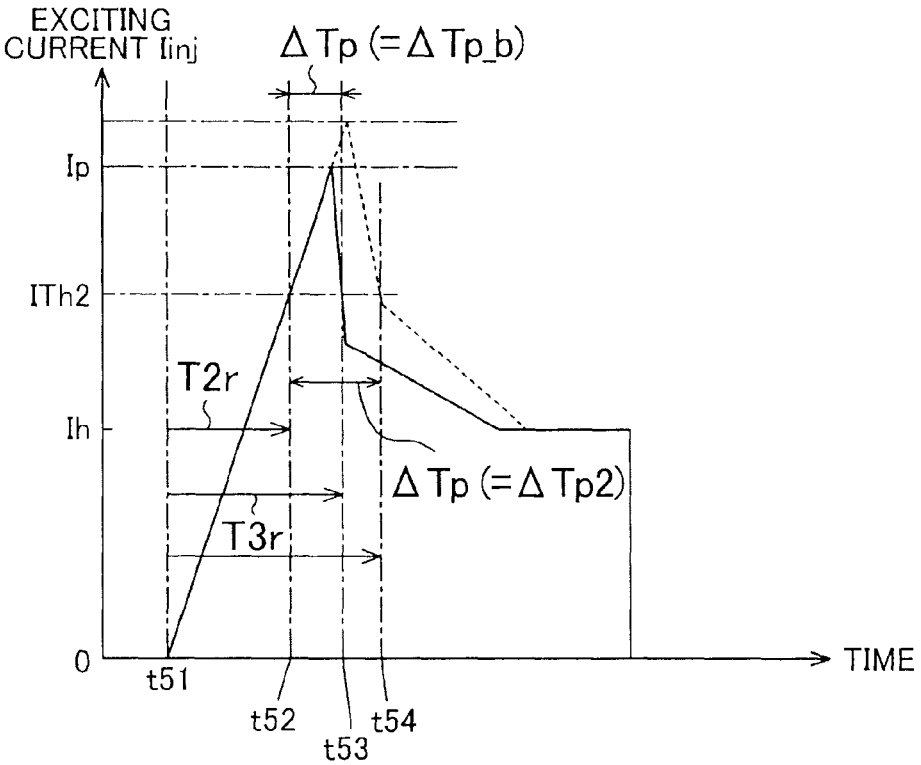
FIG. 14 is a timing chart that shows changes in exciting current in the case where the peak value of the actual exciting current is larger than the command value of the peak current value.

As shown in FIG. 13 and FIG. 14, the ECU 14 measures a reference rising time T2*r* that is a time from timing t41 or t51, which is the timing of the start of energization, to timing t42 or t52, which is the timing at which the exciting current Iinj exceeds a reference current value ITh2. The reference current value ITh2 is determined to a value that is smaller than the determined peak current value Ip and that is larger than the holding current value Ih.

The ECU 14 measures a reference falling time T3*r* that is a time from the first timing t41 or t51, which is the timing of the start of energization, to timing t44 or t53 at which the exciting current Iinj becomes smaller than the reference current value ITh2 at the time when the exciting current Iinj reduces. The ECU 14 sets the difference (=T3*r*−T2*r*) to the differential time ΔTp, regarding as a second time, by subtracting the reference rising time T2*r* from the reference falling time T3*r*.

The timing t42 and the timing t52 each are reference rising detection timing in the case where the peak value of the actual exciting current Iinj is equal to the peak current value Ip that is the command value. The timing t44 and the timing t53 each are reference falling detection timing in the case where the peak value of the actual exciting current Iinj is equal to the peak current value Ip that is the command value. The differential time ΔTp that is calculated in the case where the peak value of the actual exciting current Iinj is equal to the peak current value Ip that is the command value is set as the reference differential time ΔTp_b.

In contrast, the dashed line shown in FIG. 13 shows an example of changes in the exciting current Iinj in the case where the peak value of the actual exciting current Iinj is smaller than the peak current value Ip that is the command value. In this case, as indicated by the dashed line in FIG. 13, when it is assumed that the rate of increase in the exciting current Iinj at the time when the exciting current Iinj increases toward the peak current value remains unchanged, the reference rising timing coincides with that in the case where the peak value of the actual exciting current Iinj is equal to the peak current value Ip that is the command value. However, because the timing at which the exciting current Iinj starts reducing is earlier than that in the case where the peak value of the actual exciting current Iinj is equal to the peak current value Ip that is the command value, the reference falling timing becomes the timing t43 earlier than the timing t44. In this case, a period from the timing t42 to the timing t43 is the differential time ΔTp. Thus, the differential time ΔTp in this case is a first differential time ΔTp1 shorter than the reference differential time ΔTp_b. Here, the reason why it is allowed to assume that the rate of increase in the exciting current Iinj at the time when the exciting current Iinj increases toward the peak current value even when the peak value of the exciting current Iinj is different is that, in this case, the energization time TI is sufficiently long and the deviation between the peak value of the actual exciting current Iinj and the peak current value Ip is significantly small.

The dashed line shown in FIG. 14 shows an example of changes in the exciting current Iinj in the case where the peak value of the actual exciting current Iinj is larger than the peak current value Ip that is the command value. In this case, as indicated by the dashed line in FIG. 14, when it is assumed that the rate of increase in the exciting current Iinj at the time when the exciting current Iinj increases toward the peak current value remains unchanged, the reference rising timing coincides with that in the case where the peak value of the actual exciting current Iinj is equal to the peak current value Ip that is the command value. However, because the timing at which the exciting current Iinj starts decreasing is later than that in the case where the peak value of the actual exciting current Iinj is equal to the peak current value Ip that is the command value, the reference falling timing is timing t54 later than the timing t53. In this case, a period from the timing t52 to the timing t54 is the differential time ΔTp. Thus, the differential time ΔTp in this case is a second differential time ΔTp2 longer than the reference differential time ΔTp_b.

Thus, it is possible to estimate whether the peak value of the actual exciting current Iinj is larger than the peak current value Ip or smaller than the peak current value Ip and a deviation between the peak value of the actual exciting current Iinj and the peak current value Ip on the basis of the thus calculated differential time ΔTp.

Next, the operation at the time when fuel is injected from each fuel injection valve 20 on the basis of the peak current value Ip determined through the above-described series of processes will be described. Immediately before energization of one of the fuel injection valves 20 is started, the energization time TI and the peak current value Ip are determined for the fuel injection valve 20 (step S11, step S12). At this time, the energization time TI is, for example, determined to be larger as the required injection amount increases.

At the time of determining the peak current value Ip, the peak command base value Ip_b is increased as the fuel pressure sensor value Pa_s at the start of energization increases (step S105). As the pressure difference ΔPa that is calculated from the fuel pressure prescribed value Pa_th and the fuel pressure sensor value Pa_s at the timing of the start of energization increases, the amount of fuel discharged from the high-pressure fuel pump 53 increases. As the amount of discharge increases in this way, pulsation of the fuel pressure that can be generated in the delivery pipe 54 increases. Therefore, as the pressure difference ΔPa increases, the discharge amount correction value Ip_pa is increased (step S106).

Due to individual difference, aged degradation, and the like, of the fuel injection valves 20 and current detection circuits 42, the peak value of the actual exciting current Iinj may deviate from the peak current value Ip that is the command value. As described above, an opening failure, such as a delay in the opening of the fuel injection valve 20, may occur in the case where the peak value of the actual exciting current Iinj is smaller than the peak current value Ip, and a delay in the closing of the fuel injection valve immediately after the end of energization may occur in the case where the peak value of the actual exciting current Iinj is larger than the peak current value Ip. Therefore, in the control device 10 for the fuel injection valves according to the present embodiment, the differential time ΔTp that corresponds to the difference between the peak value of the actual exciting current Iinj and the peak current value Ip is calculated in advance (step S202), and the peak variation correction value Ip_tp is calculated on the basis of the pre-calculated differential time Tp at the current timing of the start of energization (step S107).

In the control device 10 for the fuel injection valves according to the present embodiment, the prescribed rising time T1*r* that is a value corresponding to the rate of increase in the exciting current Iinj flowing through the solenoid 21 is calculated in advance. At the current timing of the start of energization, the rate correction value Ip_v is calculated on the basis of the pre-calculated prescribed rising time T1*r*.

When the values Ip_b, Ip_pa, Ip_tp, Ip_v are calculated as described above, the peak current value Ip is calculated on the basis of the above-described relational expression (1) (step S12). When the peak current value Ip is determined in this way, the fuel injection valve 20 is controlled on the basis of the energization time TI and the peak current value Ip (step S13).

However, when the energization time TI set on the basis of the required injection amount is shorter than the reference energization time TI_b (NO in step S103), the peak current value Ip is fixed to the lower limit value Ip_min. The fuel injection valve 20 is controlled on the basis of the peak current value Ip (=Ip_min), so fuel in an adequate amount appropriate to the required injection amount is injected from the fuel injection valve 20 by appropriately setting the energization time TI.

According to the above-described configuration and operation, the following advantageous effects are obtained.

(1) In the control device 10 for the fuel injection valves according to the present embodiment, in addition to the fuel pressure sensor value Pa_s at the timing of the start of energization, the peak current value Ip is determined on the basis of the amount of fuel discharged from the high-pressure fuel pump 53. Thus, even when the fuel pressure sensor value Pa_s at the timing of the start of energization is about the same, the peak current value Ip is increased as pulsation of the fuel pressure that can be generated in the delivery pipe 54 increases. Therefore, when a large amount of fuel is supplied from the high-pressure fuel pump 53 to the delivery pipe 54 and the fuel pressure may increase, it is possible to suppress occurrence of a delay in the opening of the fuel injection valve 20 by increasing the peak current value Ip.

On the other hand, when the amount of fuel discharged from the high-pressure fuel pump 53 is small, the peak current value Ip is reduced. That is, even when the fuel pressure sensor value Pa_s at the timing of the start of energization is about the same, the peak current value Ip is reduced as pulsation of the fuel pressure that can be generated in the delivery pipe 54 reduces. By controlling the fuel injection valve 20 on the basis of the thus determined peak current value Ip, it is possible to reduce the electromagnetic force that is generated at the fuel injection valve 20. In this case, a residual magnetic force immediately after the end of energization tends to reduce, so it is possible to suppress a delay in the closing of the fuel injection valve 20 after the end of energization.

Thus, by appropriately determining the peak current value Ip on the basis of the amount of fuel discharged from the high-pressure fuel pump 53, which correlates with the amount of increase in the fuel pressure, it is possible to suppress a delay in the closing of the fuel injection valve 20 after the end of energization while avoiding a delay in the opening of the fuel injection valve 20.

(2) The amount of fuel discharged from the high-pressure fuel pump 53 reduces as the pressure difference ΔPa that is the difference between the fuel pressure sensor value Pa_s and the fuel pressure prescribed value Pa_th reduces, so the peak current value Ip is reduced as the pressure difference ΔPa reduces. Thus, by monitoring the fuel pressure sensor value Pa_s and determining the peak current value Ip on the basis of the pressure difference ΔPa, it is possible to implement the configuration that the peak current value Ip is reduced as the amount of fuel discharged from the high-pressure fuel pump 53 reduces. By controlling fuel injection from the fuel injection valve 20 on the basis of the peak current value Ip, it is possible to suppress a delay in the closing of the fuel injection valve 20 after the end of energization while avoiding a delay in the opening of the fuel injection valve 20.

(3) When the energization time TI is shorter than the reference energization time TI_b, the degree of magnetization of the solenoid 21 of the fuel injection valve 20 varies with the magnitude of the peak current value Ip, and it becomes difficult to appropriately control the fuel injection amount through control over the energization time TI. Therefore, when the energization time TI is shorter than the reference energization time TI_b, the peak current value Ip is determined to a value equal to the lower limit value Ip_min, and is fixed to a constant value. Thus, even when the energization time TI is short, it is possible to appropriately control the fuel injection amount from the fuel injection valve 20 by appropriately determining the energization time TI.

(4) On the other hand, when the energization time TI is longer than or equal to the reference energization time TI_b, the peak current value Ip is determined on the basis of the fuel pressure sensor value Pa_s at the timing of the start of energization, the pressure difference ΔPa, and the like. By controlling the fuel injection valve 20 on the basis of the thus determined peak current value Ip in this way, it is possible to suppress a delay in the closing of the fuel injection valve 20 after the end of energization while avoiding a delay in the opening of the fuel injection valve 20.

(5) In the control device 10 for the fuel injection valves according to the present embodiment, the prescribed rising time T1*r* is measured as a value that corresponds to the rate of increase in the exciting current Iinj, and the peak current value Ip is increased as the prescribed rising time T1*r* becomes shorter. Thus, it is possible to increase the actual electromagnetic force that is generated at the fuel injection valve 20 at the timing at which the exciting current Iinj has reached the peak current value Ip, that is, the maximum value of the electromagnetic force that is generated at the fuel injection valve 20 in single fuel injection. Thus, even when the rate of increase in the exciting current Iinj is high, it is possible to further reliably increase the actual electromagnetic force, generated at the fuel injection valve 20, to the electromagnetic force that is able to open the fuel injection valve 20, so it is possible to suppress Occurrence of an opening failure of the fuel injection valve 20.

(6) When the peak value of the actual exciting current Iinj is smaller than the peak current value Ip that is the command value, the maximum value of the electromagnetic force, which can be generated at the fuel injection valve 20 in single fuel injection, reduces, so an opening failure of the fuel injection valve 20 tends to occur. Therefore, in the present embodiment, when it is presumable that the difference (=ΔTp−ΔTp_b) obtained by subtracting the reference differential time ΔTp_b from the differential time ΔTp is a negative value and the peak value of the actual exciting current Iinj is smaller than the peak current value Ip, the peak current value Ip is increased. Thus, when the peak value of the actual exciting current Iinj is smaller than the peak current value Ip that is the command value, it is possible to increase the maximum value of the electromagnetic force that can be generated at the fuel injection valve 20 in single fuel injection. Thus, it is possible to suppress occurrence of an opening failure of the fuel injection valve 20.

(7) On the other hand, when the peak value of the actual exciting current Iinj is larger than the peak current value Ip that is the command value, the maximum value of the electromagnetic force that can be generated at the fuel injection valve 20 in single fuel injection increases, and a delay in the closing of the fuel injection valve 20 after the end of energization tends to occur. Therefore, in the present embodiment, when it is estimated that the difference (=ΔTp−ΔTp_b) obtained by subtracting the reference differential time ΔTp_b from the differential time ΔTp is a positive value and the peak value of the actual exciting current Iinj is larger than the peak current value Ip, the peak current value Ip is reduced. Thus, when the peak value of the actual exciting current Iinj is larger than the peak current value Ip that is the command value, it is possible to reduce the maximum value of the electromagnetic force that can be generated at the fuel injection valve 20 in single fuel injection. Thus, a residual magnetic force immediately after the end of energization reduces, so it is possible to suppress a delay in the closing of the fuel injection valve 20 immediately after the end of energization.

The above-described embodiment may be modified into the following alternative embodiments. When a deviation between the peak value of the actual exciting current Iinj and the peak current value Ip that is the command value is negligible, the peak current value Ip does not need to be corrected due to the deviation. That is, the process of step S107 may be omitted from the flowchart shown in FIG. 5. By employing such a control configuration as well, advantageous effects equivalent to the above (1) to (5) are obtained.

When variations in the rate of increase in the exciting current Iinj due to individual difference, aged degradation, and the like, of the fuel injection valves 20 and current detection circuits 42 are small and the variations are negligible, the peak current value Ip does not need to be corrected on the basis of the rate of increase in the exciting current Iinj. That is, the process of step S108 may be omitted from the flowchart shown in FIG. 5. By employing such a control configuration as well, advantageous effects equivalent to the above (1) to (4), (6) and (7) are obtained.

As long as the peak current value Ip is determined on the basis of the fuel pressure in the delivery pipe 54 at the timing of the start of energization and the magnitude of pulsation of the fuel pressure that can be generated after the timing of the start of energization, the peak current value Ip may be determined by another method other than the method of determining the peak current value Ip on the basis of the fuel pressure sensor value Pa_s at the timing of the start of energization and the pressure difference ΔPa.

Figure 15:
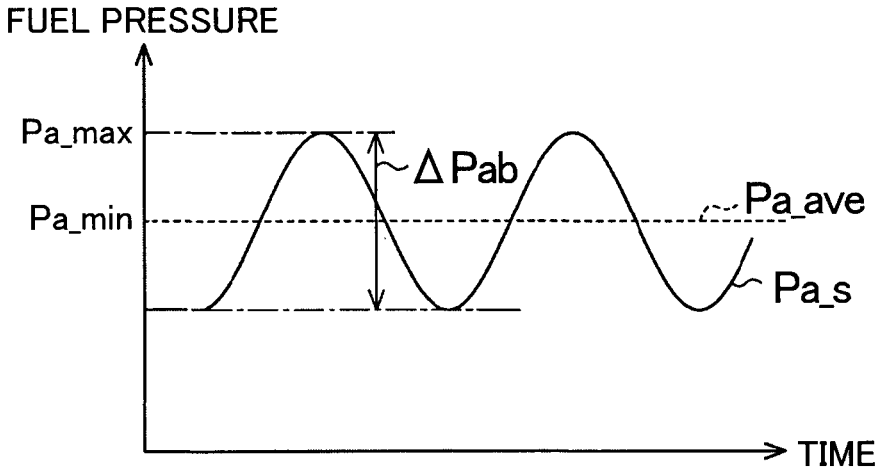
FIG. 15 is a timing chart that shows the relationship between a variation in fuel pressure sensor value and both an averaged sensor value and a pressure difference.

For example, as shown in FIG. 15, fluctuations in the fuel pressure sensor value Pa_s based on fuel injection from the fuel injection valves 20 and supply of fuel from the high-pressure fuel pump 53 to the delivery pipe 54 are monitored, and an averaged sensor value Pa_ave obtained by averaging the fluctuations in the fuel pressure sensor value Pa_s is calculated. When the fuel pressure sensor value Pa_s fluctuates as shown in FIG. 15, the pressure difference ΔPab between the upper limit value Pa_max and lower limit value Pa_min of the fluctuating fuel pressure sensor value Pa_s indicates the magnitude of pulsation of the fuel pressure due to fuel discharged from the high-pressure fuel pump 53. Therefore, the peak command base value is calculated such that the above-described averaged sensor value Pa_ave reduces, and the discharge amount correction value is calculated so as to reduce as the above-described pressure difference ΔPab reduces. The calculated peak command base value and the discharge amount correction value may be added together, and then the peak current value Ip may be determined on the basis of the resultant sum.

Even by employing such a calculation method as well, it is possible to determine the peak current value Ip in consideration of not only the fuel pressure in the delivery pipe 54 at the timing of the start of energization but also the amount of fuel discharged from the high-pressure fuel pump 53, which correlates with the amount of increase in the fuel pressure. By controlling the fuel injection valve 20 on the basis of the peak current value Ip, it is possible to suppress a delay in the closing of the fuel injection valve 20 while avoiding a delay in the opening of the fuel injection valve 20.

The invention claimed is:

1. A control device for a fuel injection valve, comprising:

an electronic control unit configured to:

(a) control open/close operation of the fuel injection valve by passing exciting current to a solenoid of the fuel injection valve that injects fuel supplied from a delivery pipe, (b) reduce a peak current value of the exciting current, with which the solenoid is energized, as a fuel pressure in the delivery pipe decreases at timing of a start of energization of the fuel injection valve, and (c) reduce the peak current value as an amount of fuel discharged from a high-pressure fuel pump to the delivery pipe reduces, wherein the electronic control unit is configured to cause the high-pressure fuel pump to discharge a large amount of fuel when a sensor value of the fuel pressure in the delivery pipe, detected by a fuel pressure sensor, is smaller than a predetermined value and as the sensor value of the fuel pressure reduces, and the electronic control unit is configured to reduce the peak current value as a difference between the sensor value of the fuel pressure and the predetermined value reduces.

2. The control device according to claim 1, wherein a lower limit value of the peak current value is set, and the electronic control unit is configured to set the peak current value to a value equal to the lower limit value when an energization time, that is a time during which the exciting current is passed through the solenoid of the fuel injection valve, is shorter than a predetermined time.

3. The control device according to claim 1, wherein the electronic control unit is configured to increase the peak current value as a rate of increase in the exciting current flowing through the solenoid of the fuel injection valve from the start of energization of the fuel injection valve increases.

4. A control device for a fuel injection valve, comprising: an electronic control unit configured to:

(a) control open/close operation of the fuel injection valve by passing exciting current to a solenoid of the fuel injection valve that injects fuel supplied from a delivery pipe, (b) reduce a peak current value of the exciting current, with which the solenoid is energized, as a fuel pressure in the delivery pipe decreases at timing of a start of energization of the fuel injection valve, and (c) reduce the peak current value as an amount of fuel discharged from a high-pressure fuel pump to the delivery pipe reduces, wherein the electronic control unit is configured to increase the peak current value as a first time reduces, the first time is a time interval from the timing of the start of energization of the fuel injection valve to timing at which the exciting current flowing through the solenoid exceeds a predetermined first current value in a process in which the exciting current increases.

5. A control device for a fuel injection valve, comprising: an electronic control unit configured to:

(a) control open/close operation of the fuel injection valve by passing exciting current to a solenoid of the fuel injection valve that injects fuel supplied from a delivery pipe, (b) reduce a peak current value of the exciting current, with which the solenoid is energized, as a fuel pressure in the delivery pipe decreases at timing of a start of energization of the fuel injection valve, and (c) reduce the peak current value as an amount of fuel discharged from a high-pressure fuel pump to the delivery pipe reduces, wherein the electronic control unit is configured to reduce the peak current value when a second time exceeds a reference value determined on the basis of a magnitude of the peak current value, and increase the peak current value when the second time is shorter than the reference value, the second time is a time interval from timing at which the exciting current flowing through the solenoid exceeds a second current value smaller than the peak current value in a process in which the exciting current increases to timing at which the exciting current flowing through the solenoid becomes smaller than the second current value in a process in which the exciting current decreases from the peak current value.

* * * * *